US010001315B2

(12) United States Patent
Wahlby et al.

(10) Patent No.: US 10,001,315 B2
(45) Date of Patent: Jun. 19, 2018

(54) DOMESTIC/PROFESSIONAL REFRIGERATOR

(71) Applicant: Electrolux Appliances Aktiebolag, Stockholm (SE)

(72) Inventors: Urban Wahlby, Osterskar (SE); Claudio Cenedese, Pasian di Prato (IT); Omero Tuzzi, Trieste (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 271 days.

(21) Appl. No.: 14/612,746

(22) Filed: Feb. 3, 2015

(65) Prior Publication Data

US 2015/0219383 A1 Aug. 6, 2015

(30) Foreign Application Priority Data

Feb. 4, 2014 (EP) ..... 14153832

(51) Int. Cl.

| | |
|---|---|
| ***F25D 17/06*** | (2006.01) |
| ***F25D 17/04*** | (2006.01) |
| ***F25D 25/02*** | (2006.01) |
| ***F25B 49/00*** | (2006.01) |
| ***F24F 3/16*** | (2006.01) |
| ***F25D 11/00*** | (2006.01) |
| ***B65D 81/24*** | (2006.01) |
| ***C07C 7/12*** | (2006.01) |
| ***G01N 29/02*** | (2006.01) |

(Continued)

(52) U.S. Cl.

CPC ..... *F25D 17/065* (2013.01); *F25D 17/042* (2013.01); *F25D 23/12* (2013.01); *F25D 29/00* (2013.01); *F25D 2500/06* (2013.01); *F25D 2700/121* (2013.01)

(58) Field of Classification Search

CPC ..... F25D 17/06; F25D 17/04; F25D 25/02; F25D 11/00; F25B 49/00; F24F 3/16; B65D 81/24; C07C 7/12; G01N 29/02

USPC ..... 62/78, 127, 179, 91, 176.6, 440; 585/821; 206/205; 73/24.06; 55/385.1

See application file for complete search history.

(56) References Cited

U.S. PATENT DOCUMENTS 4,142,372 A * 3/1979 Kato ..... A23B 7/148 62/78
4,829,774 A * 5/1989 Wassibauer ..... A23L 3/3418 426/419
5,451,248 A 9/1995 Sadkowski et al.

(Continued)

FOREIGN PATENT DOCUMENTS

JP H0593580 A * 4/1993 ..... A23B 7/14

*Primary Examiner* — Robert A Hopkins
*Assistant Examiner* — Minh-Chau Pham
(74) *Attorney, Agent, or Firm* — Pearne & Gordon LLP

(57) ABSTRACT

A refrigerator (1) includes a storage chamber (12) for produce storage and a produce ripening control system (10). The produce ripening control system (10) includes an ethylene absorber (18) adapted to operate in absorption mode in a first status and in desorption mode in a second status. A recirculation circuit (20) is configured to fluidly connect the absorber (18) with the storage chamber (12) and to draw air from the storage chamber (12), to flow the drawn air through the absorber (18) and to return it into the storage chamber (12). A control unit (30) configured to selectively operate the absorber either in the absorption mode for ethylene absorption or in the desorption mode for ethylene desorption.

14 Claims, 3 Drawing Sheets

(51) Int. Cl.
*F25D 23/12* (2006.01)
*F25D 29/00* (2006.01)

(56) References Cited

U.S. PATENT DOCUMENTS

| | | | | |
|---|---|---|---|---|
| 6,460,352 | B1 * | 10/2002 | Lemcoff | A23B 7/152<br>62/127 |
| 2004/0210099 | A1 * | 10/2004 | Shiratori | A23B 7/152<br>585/821 |
| 2005/0217282 | A1 * | 10/2005 | Strohm | A23B 7/152<br>62/78 |
| 2011/0204762 | A1 | 8/2011 | Eubanks et al. | |

* cited by examiner

DOMESTIC/PROFESSIONAL REFRIGERATOR

CROSS-REFERENCE TO RELATED APPLICATION

This application claims priority to European Application No. 14153832.2, filed on Feb. 4, 2014, the content of which is hereby incorporated by reference in its entirety.

BACKGROUND OF THE INVENTION

The invention relates to a refrigerator for domestic use as well as to a refrigerator for professional use such as in a restaurant, hotel and similar.

It is known that ethylene is a gas that affects produce ripening. In particular, as known, ethylene gas is a natural hormone which is released by produce at different rates, depending upon produce types. Ethylene production rates can increase with produce maturity at harvest, physical injuries (cutting, scratching, bruising, etc), disease incidence, increased temperatures (e.g. up to about 30° C.) and water stress (e.g. resulting from low relative humidity).

Ethylene is physiologically active, even at extremely low concentrations (e.g. 0.1 ppm), for produce ripening, which is a natural phenomenon, but it may also cause the decay of produce.

US 2004/0210099 discloses a method for maintaining the freshness of, or conversely controlling the maturation of, plants or perishables such as fruits, vegetables, and flowers, by controlling the concentration of ethylene gas by use of an ethylene gas adsorbent containing an alcohol extract solution of raw bamboo and a filter having held thereon the alcohol extract solution.

U.S. Pat. No. 5,451,248 discloses a system for controlling the atmosphere of a container for use in the storage and/or transportation of perishable goods which includes adsorption apparatus for the selective absorption in whole or in part and in a predetermined order of any water vapor, carbon dioxide, oxygen or ethylene contained within the atmosphere, a blower for urging the atmosphere to the absorption apparatus, and a conduiting for returning the controlled atmosphere to the container.

The applicant observes that the above documents relate to the control of the atmosphere in industrial containers for use in storage and/or transportation of perishable goods in industrial applications. In these applications, the size of the containers, the amount of perishable goods and the amount of gas/vapour under control are very large and not comparable with those of domestic applications. Differently from industrial containers, domestic and professional refrigerators are designed to store different types of food (meat, fish, dairy products, fruits, vegetables). The herein solution to control the ethylene concentration is applied only to a specific section of the domestic/professional refrigerator (e.g. drawer). Another difference between industrial containers and domestic/professional refrigerators is the final user. In the first case the user is very skilled in food preservation issues and knows well the connected processes (e.g. ripening, rotting). In the second case the user can be completely or partially unaware (e.g. housewife) or can have limited knowledge of the matter (e.g. cook). This means that in domestic/professional applications much more complexity is required in terms of control to guarantee a satisfactory function.

US 2011/0204762 discloses a domestic refrigerator comprising a sliding drawer positioned in the refrigerated compartment and utility modules sized to be positioned within the storage chamber of the sliding drawer. In an embodiment, the utility modules comprise a housing with a vented compartment defined therein, which is sized to receive a sachet containing an ethylene absorbing agent to eliminate ethylene generated by food items stored in the drawer, thereby helping to preserve food items stored in the drawer. An elapsed time indicator is provided, which provides an indication of how long the sachet has been used. When the sachet is replaced, a new indicator is provided.

It is an object of the invention to improve produce ripening management in a domestic/professional refrigerator.

The Applicant has found that this object can be achieved by a domestic/professional refrigerator comprising a produce ripening control system with an ethylene absorber adapted to selectively operate in an absorption mode and in a desorption mode. A recirculation circuit is configured to recirculate air from a storage chamber, via the ethylene absorber and back into the storage chamber. A control unit is configured to selectively operate the absorber either in the absorption mode or in the desorption mode. When the absorber operates in absorption mode, ethylene is absorbed and a first produce ripening effect (i.e. produce ripening delay) is obtained while, when the absorber operates in desorption mode, ethylene is desorbed and a second, opposite, ripening effect (i.e. produce ripening acceleration) is obtained. This advantageously provides a user with the possibility of selectively treating the produce stored in his/her refrigerator depending on current needs, thereby improving the versatility and flexibility of the domestic/professional refrigerator. In addition, it advantageously enables to fully exploit adsorbing/desorbing capabilities of ethylene absorber, thereby improving the efficiency of the produce ripening control system. Produce ripening management at domestic/professional level is thus improved.

In a first aspect the present invention thus relates to a domestic/professional refrigerator comprising a storage chamber for produce storage and a produce ripening control system, the produce ripening control system comprising:

- an ethylene absorber adapted to operate in absorption mode in a first status and in desorption mode in a second status;
- a recirculation circuit configured to fluidly connect the absorber with the storage chamber and to draw air from the storage chamber, to flow the drawn air through the absorber and to return it into the storage chamber; and
- a control unit configured to selectively operate the absorber either in the absorption mode for ethylene absorption or in the desorption mode for ethylene desorption.

Preferably, the absorber is adapted to operate in absorption mode at a temperature $T_1$ and to operate in desorption mode at a temperature $T_2$ higher than temperature $T_1$.

Preferably, the produce ripening control system further comprises a heater thermally coupled to the absorber, the control unit being configured to control the heater to operate the absorber at said temperature $T_1$ or at said temperature $T_2$.

In a preferred embodiment, said storage chamber defines a first storage chamber, and the refrigerator further comprises a second storage chamber for produce storage, the recirculation circuit being configured to fluidly connect the second storage chamber with the absorber and to draw air from the second storage chamber, to flow the drawn air through the absorber and to return it into the second storage chamber.

Preferably, the recirculation circuit is configured to fluidly connect the second storage chamber with the absorber bypassing the first storage chamber.

Preferably, the recirculation circuit is configured to fluidly connect the first storage chamber with the absorber bypassing the second storage chamber.

Preferably, the control unit is configured to operate the recirculation circuit so that in the absorption mode of the absorber the air is recirculated through the first storage chamber bypassing the second storage chamber, while in the desorption mode of the absorber the air is recirculated through the second storage chamber bypassing the first storage chamber.

Preferably, the recirculation circuit comprises air flow switching elements arranged so that the air can be recirculated into the recirculation circuit bypassing either the first storage chamber or the second storage chamber.

Preferably, the control unit is configured to operate the air flow switching elements so that in the absorption mode of the absorber the air is recirculated through the first storage chamber bypassing the second storage chamber, while in the desorption mode of the absorber the air is recirculated through the second storage chamber bypassing the first storage chamber.

The recirculation circuit could comprise a suction or blowing element configured to re-circulate air along the recirculation circuit.

Preferably, the produce ripening control system comprises a first ethylene sensor associated with the first storage chamber to sense ethylene concentration within the first storage chamber, the control unit being configured to operate the absorber and the recirculation circuit according to data received by the first ethylene sensor.

Preferably, the produce ripening control system comprises a second ethylene sensor associated with the second storage chamber to sense ethylene concentration within the second storage chamber, the control unit being configured to operate the absorber and the recirculation circuit according to data received by the second ethylene sensor.

In a preferred embodiment, the control unit is configured to operate the absorber and the recirculation circuit according to information relating to produce type stored into the first storage chamber and/or the possible second storage chamber.

In a preferred embodiment, the domestic/professional refrigerator further comprises a user interface for receiving user inputs, the control unit being configured to operate the absorber and the recirculation circuit depending on the user inputs.

Preferably, the produce type stored into the first storage chamber and/or the possible second storage chamber is received as user input via said user interface.

In a preferred embodiment, the produce ripening control system further comprises a database of produce preservation/ripening information, the control unit being configured to operate the absorber and the recirculation circuit depending on the information stored into the database.

Preferably, the information relating to the produce type stored into the first storage chamber and/or the possible second storage chamber, are retrieved from said database.

In a preferred embodiment, the produce ripening control system comprises a first temperature sensor associated with the first storage chamber to sense the temperature within the first storage chamber, the control unit being configured to adjust the temperature within the first storage chamber in cooperation with the first temperature sensor and according to information relating to produce type stored into the first storage chamber.

In a preferred embodiment, the produce ripening control system comprises a second temperature sensor associated with the second storage chamber to sense the temperature within the second storage chamber, the control unit being configured to adjust the temperature within the second storage chamber in cooperation with the second temperature sensor and according to information relating to produce type stored into the second storage chamber.

Preferably, the first storage chamber and/or the possible second storage chamber is suitably sealed.

Preferably, the first storage chamber and/or the possible second storage chamber comprises a sealed opening/closing door.

Preferably, the first storage chamber and/or the possible second storage chamber is defined by a drawer.

Preferably, the drawer comprises a gasket to seal it in a closed position.

BRIEF DESCRIPTION OF THE DRAWINGS

These and other features and advantages of the invention will better appear from the following description of some exemplary and non-limitative embodiments, to be read with reference to the attached drawings, wherein.

DETAILED DESCRIPTION OF EXAMPLE EMBODIMENTS

Figure 1:
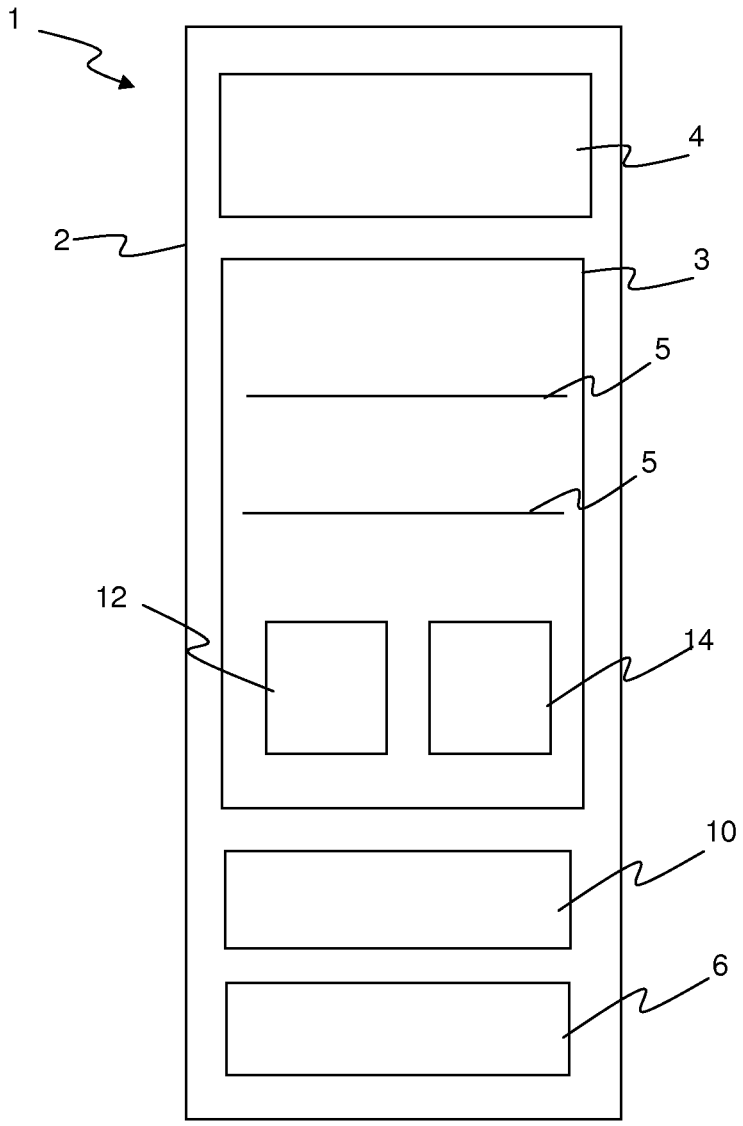
FIG. 1 schematically shows a refrigerator according to an embodiment of the invention.

FIG. 1 shows a refrigerator 1 according to an embodiment of the invention. Refrigerator 1 is an appliance for domestic or professional use, that is a household appliance, or an appliance for restaurants, hotels and similar. The refrigerator 1 comprises a cabinet 2, preferably but not necessarily parallelepiped-shaped. The cabinet 2 comprises at least one refrigerator compartment 3 for storing food items, such as, milk, cheese, meat, fish, produce, to be refrigerated. Optionally, the cabinet 2 may also comprise a freezing compartment 4.

The refrigerator compartment 3 preferably comprises a plurality of shelves 5. The refrigerator compartment 3 also comprises at least one storage chamber 12 and/or 14 for produce (e.g. fruits and vegetables) storage. The at least one storage chamber 12 and/or 14 can be configured as a drawer or as a closed crisper provided, for example, with a opening/closing door (not shown). The at least one storage chamber 12 and/or 14 is preferably sealed by means of a sealing gasket (not shown), positioned, for example, in at least part of the upper edges of the drawer or in at least part of the edge of said opening/closing door.

The cabinet 2 also comprises a conventional refrigeration circuit 6 of a know type, comprising a compressor, a condenser, a thermal expansion valve (or throttle valve) and an evaporator (not shown). Although circuit 6 has been schematically illustrated as a box, it is clear that these components can be arranged in different places of the appliance so as to provide the better cooling conditions in the refrigeration compartment 3. Therefore, refrigerator 1 is a stand-alone equipment provided with all necessary components inside it, different from industrial equipments (e.g. cold storage equipments) where the refrigerating system is typically centralized (e.g. comprising a compressor station with pipelines distributing fluid).

According to the invention, the cabinet 2 also comprises a produce ripening control system 10. In the embodiment shown in FIG. 2, the produce ripening control system 10 comprises an ethylene absorber 18, a recirculation circuit 20, a control unit 30 and, preferably, a user interface 40.

The ethylene absorber 18 and the storage chamber 12 are arranged along the recirculation circuit 20. The recirculation circuit 20 comprises a suction (or blowing) element 26, a first and a second air flow switching elements 21, 22, and air pipes 27 fluidly connecting to each other the above components and the storage chamber 12. More in detail, the first air flow switching element 21 is arranged between an air outlet 121 of the storage chamber 12 and the suction element 26, and the second air flow switching element 22 is arranged between the suction element 26 and an air inlet 122 of the storage chamber 12.

It is noted that, even if, in the figures, the absorber 18 is arranged downstream of the suction element 26, it could also be arranged upstream of the suction element 26 (the terms "downstream" and "upstream" being used with reference to the direction of the air flow inside the recirculation circuit 20).

The suction element 26 is configured to re-circulate air along the recirculation circuit 20, drawing it from the storage chamber 12 via the air outlet 121, flowing the drawn air through the first air flow switching element 21, the suction element 26 itself, the absorber 18, the second air flow switching element 22 and back into the storage chamber 12 via the air inlet 122. The suction element 26 can be, for example, a pump or a fan.

The first air flow switching element 21 and the second air flow switching element 22 can be, for example, electrovalves. The air flow switching elements 21, 22 are such as to enable air flow passage in their open state and to block air flow passage in their closed state.

The ethylene absorber 18 is adapted to operate in absorption mode in a first status and in desorption mode in a second status. In a preferred embodiment, shown in FIG. 2, the ethylene absorber 18 is adapted to operate in absorption mode at a temperature $T_1$ and in desorption mode at a temperature $T_2$ higher than $T_1$. Preferably, temperature $T_1$ is selected from a range of ambient temperatures comprised between 0° C.-15° C., while temperature $T_2$ can be comprised between 150° C.-200° C. In this embodiment, the first status corresponds to absence of applied thermal energy, while the second status corresponds to presence of applied thermal energy. The thermal energy can be applied, for example, by means of a heater 17 associated with the ethylene absorber 18.

The ethylene absorber 18 can comprise an ethylene absorbing material, such as for example zeolite or a high porosity material (like aerogel, based on syndiotactic polystyrene). The ethylene absorbing material is selected and sized so as to be able to absorb, in absorption mode, typical amounts (e.g., 2 Kg of banana generate about 2 mg of ethylene per week; 2 Kg of avocado generate about 42 mg of ethylene per week) of ethylene that can be produced during a suitable time (for example, 1-2 weeks) by produce stored in the storage chamber 12 (that are typically in an amount not higher that 1-2 kg) and to quickly (i.e. in few minutes in the desorption mode) obtain an ethylene concentration (for example, from 0.1 to 10 ppm), which is enough for accelerating ripening of the produce stored in the storage chamber 12.

According to another embodiment (not shown), the first status of operation of the ethylene absorber 18 could correspond to absence of an applied magnetic field, while the second status could correspond to presence of an applied magnetic field produced by suitable induction means.

The control unit 30 is configured to control operation of the absorber 18, the suction element 26 and the air flow switching elements 21 and 22.

In the embodiment shown, the control unit 30 is configured to selectively operate the absorber 18 either in the absorption mode or in the desorption mode by respectively switching the heater 17 off or on so as to keep the absorber 18 at the predetermined temperature $T_1$ or $T_2$.

The control unit 30 cooperates with an ethylene sensor 11 and, preferably, a temperature sensor 13, associated with the storage chamber 12 (preferably, arranged inside it) to respectively sense the ethylene concentration and the temperature within the storage chamber 12.

The present invention provides a solution that—on one side—allows to extend the shelf-life of the produce stored into the storage chamber 12, by adsorbing the ethylene gas present therein, and—on the other side—to reuse the absorbed ethylene to speed-up the ripening of the produce, depending on the user needs.

Accordingly, when a ripening delay of the produce stored into the storage chamber 12 is required, the control unit 30 is configured to open the air flow switching elements 21, 22 and to switch the suction element 26 on. In this way, the suction element 26 circulates the air through the recirculation circuit 20, including the storage chamber 12. The ethylene absorbing material contained within the absorber 18 works as a molecular sieve that traps, within its cellular structure, the ethylene molecules present in the air flow. The ethylene sensor 11 provides the control unit 30 with the ethylene concentration in the storage chamber 12. When the ethylene concentration level drops below a certain threshold, the control unit 30 ends the ripening delay process, by closing the air flow switching elements 21, 22 and switching the suction element 26 off. When the absorber saturates, a desorbing cycle can, for example, be provided.

On the other side, when a ripening acceleration of the produce stored in the storage chamber 12 is required, the control unit 30 is configured to switch the heater 17 on to heat the absorber 18. When the temperature at the absorber 18 reaches the temperature $T_2$ (measured by a suitable temperature sensor, not shown), the control unit 30 is configured to open the air flow switching elements 21, 22 and to switch the suction element 26 on. In this way, the ethylene absorbing material contained within the absorber 18 releases the ethylene molecules previously absorbed and the released ethylene is circulated by the suction element 26 through the recirculation circuit 20, including the storage chamber 12. The ethylene sensor 11 provides the control unit 30 with the ethylene concentration into the storage chamber 12. When the ethylene concentration level reaches a certain threshold, the control unit 30 ends the ripening acceleration process, by closing the air flow switching elements 21, 22 and switching the suction element 26 and the heater 17 off.

An auxiliary ethylene tank 19 is preferably provided, so that, if the absorber 18 has not enough ethylene absorbed, the necessary additional amount of ethylene can be supplied by auxiliary tank 19. For this purpose, a flow switching element 25 (e.g. an electro-valve) is arranged in the piece of conduit 27 connecting the thank 19 with the recirculation circuit 20.

In a standby mode, the air flow switching elements 21, 22, 25 are closed and the suction element 26 and heater 17 are switched off.

According to a preferred embodiment, the ethylene concentration thresholds in the ripening delay process and ripening acceleration process are selected depending on the produce type(s) stored into the storage chamber 12. The produce type(s) can be an input parameter externally provided by the user through the user-interface 40 or can be determined by the control unit 30 by suitable algorithms, for example by taking into account the quantity of ethylene released by the produce currently stored into the storage chamber 12.

Figure 2:
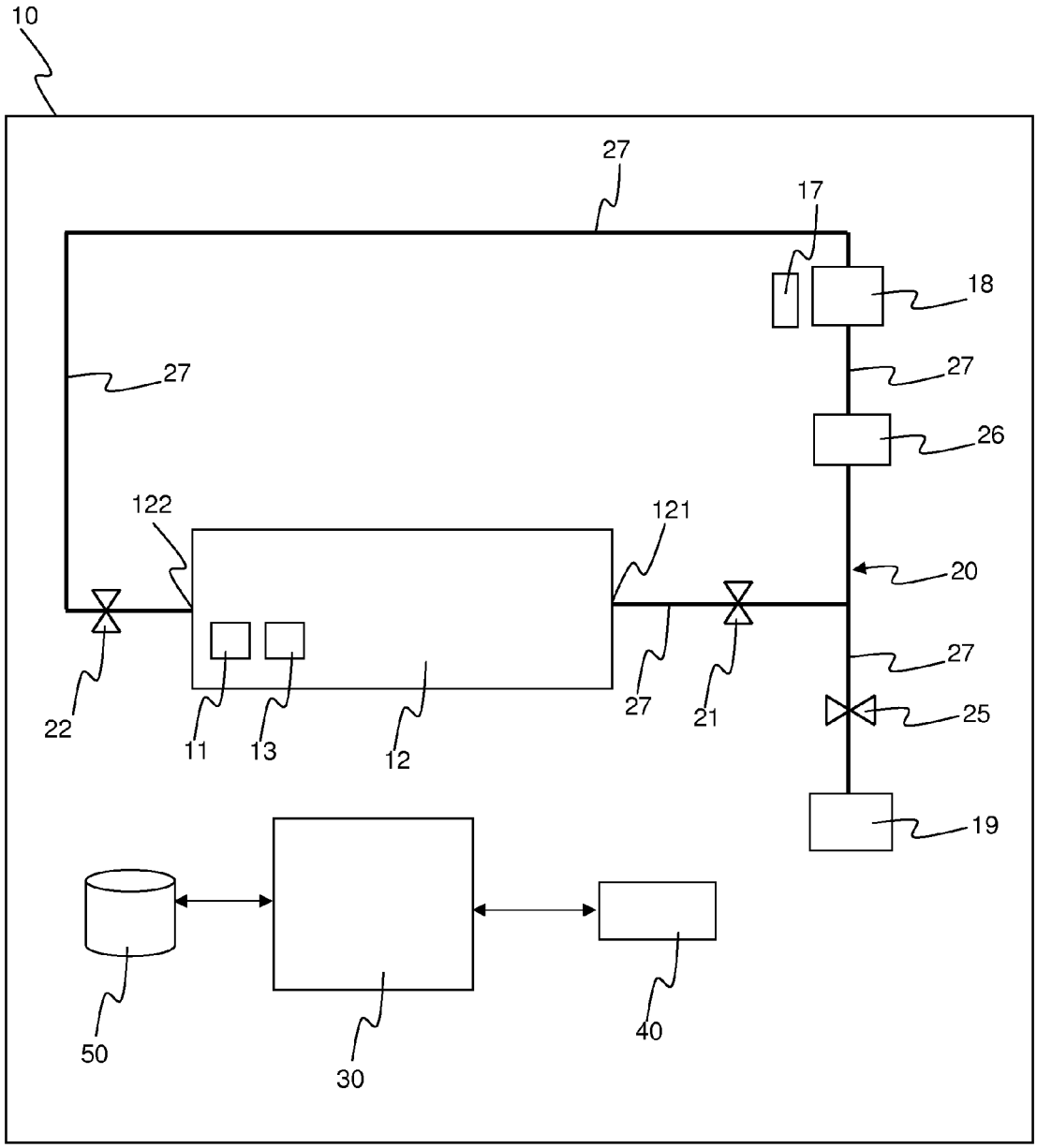
FIG. 2 schematically shows a produce ripening control system for a refrigerator, according to a first embodiment of the invention.

In a preferred embodiment, shown in FIG. 2, the control unit 30 is also configured to adjust the temperature within the storage chamber 12, in cooperation with the temperature sensor 13, depending on the produce type(s) stored into the storage chamber 12. This can further improve the produce ripening control, considering that temperature can affect produce ripening and ethylene generation in a different way, depending upon the produce type(s).

In a preferred embodiment, shown in FIG. 2, the ripening control system 10 also comprises a database 50 storing preservation/ripening information about different produce types. For example, the database can contain a list of product types each associated with corresponding ethylene thresholds and optimal temperature values. In addition, the control unit 30 is preferably configured to access the database to retrieve such information and to perform the ripening delay process and the ripening acceleration process accordingly.

Figure 3:
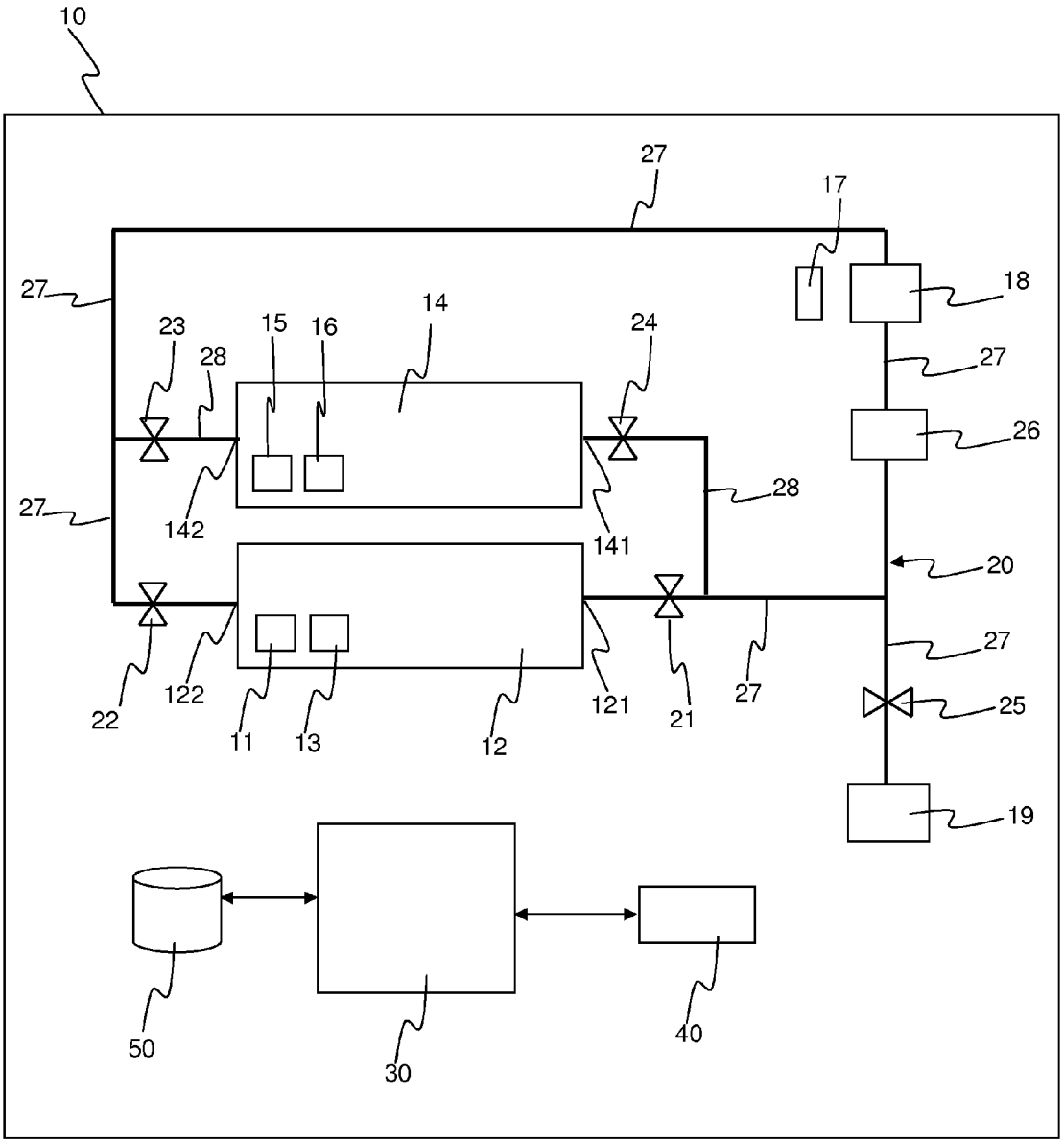
FIG. 3 schematically shows a produce ripening control system for a refrigerator, according to a second embodiment of the invention.

FIG. 3 shows the produce ripening control system 10 of refrigerator 1 according to another preferred embodiment of the invention.

The produce ripening control system 10 according to this embodiment is similar to that of FIG. 2 except for the fact that, in addition to the storage chamber 12, which defines a first storage chamber, there is a second storage chamber 14. In particular, the recirculation circuit 20 is also fluidly connected to the second storage chamber 14 via additional air pipes 28, a third air flow switching elements 23 arranged between the suction element 26 and an air inlet 142 of the second storage chamber 14, and a fourth air flow switching element 24 arranged between an air outlet 141 of the second storage chamber 14 and the suction element 26.

In this case, the suction element 26 is also configured to re-circulate air along the recirculation circuit 20, drawing air from the second storage chamber 14 via the air outlet 141, flowing the drawn air through the fourth air flow switching element 24, the suction element 26 itself, the absorber 18, the third air flow switching element 23 and to return it into the second storage chamber 14 via the air inlet 142.

Furthermore, the control unit 30 is preferably configured to operate the air flow switching elements 21, 22, 23 and 24 so that in the absorption mode of the absorber 18 the air is circulated through the first storage chamber 12 bypassing the second storage chamber 14, while in the desorption mode of the absorber 18 the air is circulated through the second storage chamber 14 bypassing the first storage chamber 12.

In this way, the first storage chamber 12 can be assigned to the produce ripening delay process while the second storage chamber 14 can be assigned to the produce ripening acceleration process.

When a ripening delay of the produce stored into the first storage chamber 12 is required, the control unit 30 is configured to open the air flow switching elements 21, 22 and to switch the suction element 26 on, while the air flow switching elements 23, 24 are kept closed. In this way, the suction element 26 circulates the air through the recirculation circuit 20, including the first storage chamber 12, but bypassing the second storage chamber 14. The ethylene absorbing material contained within the absorber 18 works as a molecular sieve, trapping the ethylene molecules present in the air flow. The ethylene sensor 11 provides the control unit 30 with the relative ethylene concentration into the first storage chamber 12. When the ethylene concentration level drops below a certain threshold, the control unit 30 ends the ripening delay process, by closing the air flow switching elements 21, 22 and switching the suction element 26 off. If, in this process, the absorber 18 saturates, a desorbing cycle can, for example, be provided.

On the other side, when a ripening acceleration of the produce stored into the second storage chamber 14 is desired, the control unit 30 is configured to switch the heater 17 on in order to heat the absorber 18. When the temperature at the absorber 18 reaches the temperature $T_2$ (measured by a suitable temperature sensor, not shown), the control unit 30 is configured to open the air flow switching elements 23, 24 and to switch the suction element 26 on, while the air flow switching elements 21, 22 are kept closed. In this way, the ethylene absorbing material contained within the absorber 18 releases the ethylene molecules previously absorbed and the released ethylene is circulated by the suction element 26 through the recirculation circuit 20, including the second storage chamber 14, bypassing the first storage chamber 12. Ethylene sensor 15 associated with the second storage chamber 14 provides the control unit 30 with the relative ethylene concentration. When the ethylene concentration level in the second storage chamber 14 reaches a certain threshold, the control unit 30 ends the ripening acceleration process, by closing the air flow switching elements 23, 24 and switching the suction element 26 and the heater 17 off. If the absorber 18 has not enough ethylene absorbed, auxiliary ethylene tank 19 can be used to supply the necessary ethylene through flow switching element 25.

According to this embodiment, a user can selectively store the produce either in the storage chamber 12 or in the storage chamber 14 depending on the treatment he/she desires for the produce to be stored therein.

Moreover, as in the embodiment of FIG. 2, also in this embodiment, the control unit 30 can be preferably configured to adjust the temperature within the first storage chamber 12 and the second storage chamber 14, working in cooperation with temperature sensor 13 and temperature sensor 16, respectively, depending on the produce type(s) stored into the storage chambers 12, 14.

Furthermore, also in this embodiment, the ethylene concentration thresholds and optimal temperature values to be used in the ripening delay process and ripening acceleration process can be preferably selected depending on the produce type(s) stored into the storage chambers 12, 14.

Information about produce type(s) stored into the storage chambers 12, 14 can be retrieved from database 50 and/or from user inputs via user interface 40.

From the above description, it is clear that the invention, in the various embodiments thereof, advantageously enables to improve post-harvest produce management at the domestic/professional level. In particular, the invention provides the user with a versatile and flexible tool enabling him/her to decide, depending on current needs, either to accelerate ripening of the produce stored in his/her refrigerator (useful, for example, in those cases when green produce is purchased that cannot be immediately eaten) or to extend the produce freshness and shelf life without introducing potentially harmful chemicals. Moreover, by fully exploiting both the absorbing and desorbing capabilities of the absorber, the invention advantageously enables to perform a virtuous process wherein the absorbed ethylene for ripening delay purposes is not removed but stored and subsequently recycled for use in fast ripening.

The Applicant observes that, even though the absorber 18 has been disclosed with reference to ethylene, it may also be configured to absorb/desorb other gases, such as for example, carbon dioxide, and/or water vapor, that may affect the preservation/ripening/freshness of the produce stored into the storage chamber 12 and/or the storage chamber 14.

In addition, while one absorber has been described, the invention also contemplates the case wherein the ripening control system comprises two absorbers connected in parallel to be operated simultaneously in opposite operating modes. In this way, when one absorber is operated in absorption mode with the first storage chamber 12, the other absorber can be operated in desorption mode with the second storage chamber 14. In this way, ripening delay process and ripening acceleration process can be performed simultaneously, thereby improving the versatility and efficiency of the produce management.

It is also clear that the refrigerator of the present invention can comprise any number of storage chambers or containers, and the control unit 30 may be configured so as to use any of them for ripening delay and any of them for ripening acceleration, by a proper control of corresponding switching elements, of the suction element 26 and of the heater 17.

The invention claimed is:

1. A refrigerator, comprising:

a refrigerator circuit including a compressor, a condenser, a thermal expansion valve, and an evaporator;

a storage chamber for produce storage; and a produce ripening control system, the produce ripening control system comprising:

an ethylene absorber adapted to operate in absorption mode in a first status and in desorption mode in a second status, wherein the ethylene absorber operates in the absorption mode at a temperature T1, and operates in the desorption mode at a temperature T2 that is higher than temperature T1;

a recirculation circuit configured to fluidly connect the absorber with the storage chamber and to draw air from the storage chamber, to flow the drawn air through the absorber and to return it into the storage chamber;

a control unit configured to selectively operate the absorber either in the absorption mode for ethylene absorption or in the desorption mode for ethylene desorption; and a heater associated with and thermally coupled to the ethylene absorber, wherein the control unit is further configured to switch the heater on or off to operate the ethylene absorber at the temperature T1 or the temperature T2.

2. A refrigerator according to claim 1, wherein said storage chamber defines a first storage chamber, and wherein the refrigerator further comprises a second storage chamber for produce storage, the recirculation circuit being configured to fluidly connect the second storage chamber with the absorber and to draw air from the second storage chamber, to flow the drawn air through the absorber and to return it into the second storage chamber.

3. A refrigerator according to claim 2, wherein the recirculation circuit is configured to fluidly connect the second storage chamber with the absorber bypassing the first storage chamber.

4. A refrigerator according to claim 2, wherein the recirculation circuit is configured to fluidly connect the first storage chamber with the absorber bypassing the second storage chamber.

5. A refrigerator according to claim 2, wherein the control unit is configured to operate the recirculation circuit so that in the absorption mode of the absorber the air is recirculated through the first storage chamber bypassing the second storage chamber, while in the desorption mode of the absorber the air is recirculated through the second storage chamber bypassing the first storage chamber.

6. A refrigerator according to claim 2, wherein the recirculation circuit comprises air flow switching elements arranged so that the air can be recirculated into the recirculation circuit bypassing either the first storage chamber or the second storage chamber.

7. A refrigerator according to claim 6, wherein the control unit is configured to operate the air flow switching elements so that in the absorption mode of the absorber the air is recirculated through the first storage chamber bypassing the second storage chamber, while in the desorption mode of the absorber the air is recirculated through the second storage chamber bypassing the first storage chamber.

8. A refrigerator according to claim 1, wherein the control unit is configured to operate the absorber and the recirculation circuit according to information relating to produce type stored in the storage chamber.

9. A refrigerator according to claim 1, further comprising a user interface for receiving user inputs, the control unit being configured to operate the absorber and the recirculation circuit depending on the user inputs.

10. A refrigerator according to claim 9, wherein the produce type stored into the storage chamber is received as user input via said user interface.

11. A refrigerator according to claim 1, wherein the produce ripening control system further comprises a database of produce preservation/ripening information, the control unit being configured to operate the absorber and the recirculation circuit depending on the information stored in the database.

12. A refrigerator according to claim 11, wherein the information relating to the produce type stored into the storage chamber are retrieved from said database.

13. A refrigerator according to claim 1, wherein the produce ripening control system comprises a temperature sensor associated with the storage chamber to sense the temperature within the storage chamber, the control unit being configured to adjust the temperature within the storage chamber in cooperation with the temperature sensor and according to information relating to produce type stored in the storage chamber.

14. The refrigerator according to claim 1, wherein T1 is selected from an ambient temperature range of 0° C.-15° C., and wherein T2 is selected from an ambient temperature range of 150° C.-200° C.

* * * * *